United States Patent [19]

Rüter

[11] Patent Number: 5,007,539

[45] Date of Patent: Apr. 16, 1991

[54] PACKAGE AND PACKING BODY FOR SMALL COMPONENTS

[75] Inventor: Hans-Werner Rüter, Klein Nordende, Fed. Rep. of Germany

[73] Assignee: U.S. Philips Corporation, New York, N.Y.

[21] Appl. No.: 506,496

[22] Filed: Apr. 9, 1990

Related U.S. Application Data

[60] Continuation of Ser. No. 369,569, Jun. 21, 1989, abandoned, which is a division of Ser. No. 298,191, Jan. 13, 1989, Pat. No. 4,860,521, which is a continuation of Ser. No. 83,545, Aug. 6, 1987, abandoned.

[30] Foreign Application Priority Data

Aug. 7, 1986 [DE] Fed. Rep. of Germany ..... 3626765

[51] Int. Cl.[5] ..... B65D 81/02; B65B 15/04

[52] U.S. Cl. ..... 206/524; 53/397; 53/453; 53/472; 206/589; 206/592

[58] Field of Search ..... 206/523, 524, 584, 588, 206/589, 592, 593; 53/397, 453, 472

[56] References Cited

U.S. PATENT DOCUMENTS

| | | | |
|---|---|---|---|
| 1,513,148 | 10/1924 | Bartlett | 206/584 X |
| 2,228,493 | 1/1941 | Will | 206/523 X |
| 2,287,425 | 6/1942 | Fox | 206/523 X |
| 2,860,768 | 11/1958 | Smithers | 206/523 |
| 3,095,677 | 7/1963 | Dreyfus et al. | 53/453 X |
| 3,181,766 | 5/1965 | Kane et al. | 206/523 X |
| 3,201,911 | 8/1965 | Woodland | 206/524 X |
| 3,870,741 | 3/1975 | Kuhn | 206/524 X |
| 4,071,043 | 1/1978 | Carlson | 206/523 X |
| 4,657,138 | 4/1987 | Watson | 206/523 X |
| 4,860,521 | 8/1989 | Rüter | 53/397 |

FOREIGN PATENT DOCUMENTS

| | | | |
|---|---|---|---|
| 1697030 | 3/1955 | Fed. Rep. of Germany . | |
| 6904519 | 5/1969 | Fed. Rep. of Germany . | |
| 3236570 | 4/1984 | Fed. Rep. of Germany . | |
| 1462407 | 12/1966 | France | 206/523 |
| 838659 | 6/1960 | United Kingdom . | |
| 856558 | 12/1960 | United Kingdom | 206/523 |

*Primary Examiner*—Bryon P. Gehman
*Attorney, Agent, or Firm*—Robert T. Mayer

[57] ABSTRACT

A packing of small components, in which at least one small component (9) is packed by means of a packing body (1) having a multilayer construction and comprising a relatively non-deformable base plate (3) and a thermoplastically deformable elastic carrier layer (5) fixedly connected to the base plate, the small component (9) being depressed into the heated carrier layer (5) thereby forming a nest by thermoplastic deformation of the carrier layer.

5 Claims, 1 Drawing Sheet

PACKAGE AND PACKING BODY FOR SMALL COMPONENTS

Figure 1:
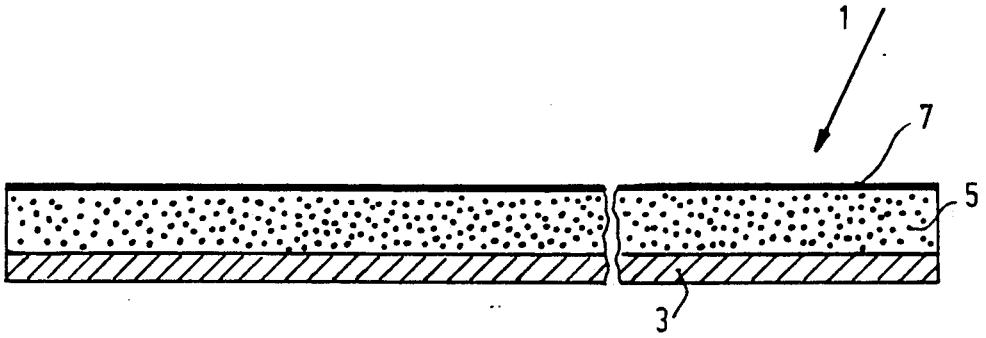

This is a continuation of application Ser. No. 369,569, filed June 21, 1989, now abandoned, which is a division of application Ser. No. 298,191 filed Jan. 13, 1989, now U.S. Pat. No. 4,860,521, which was a continuation of application Ser. No. 83,545, filed Aug. 6, 1987, now abandoned.

The invention relates to a method of packing small components with the use of a packing body having a multilayer construction and comprising a non-deformable base plate and an elastic thermoplastically deformable carrier layer fixedly connected to the base plate.

In processes for technical mass production, manufactured components require packings which on the one hand protect breakable parts, but which on the other hand are also suitable to ensure that the packed components can readily be taken therefrom by machine or by hand in always the same position, more particularly if, for example, the packed components should be subjected to further manufacturing steps. Moreover, more and more packings are required which join smaller numbers of components to form a set in order that adaptation can be effected more rapidly in a further processing step, to which the packed components, for example semi-manufactured articles, are to be subjected.

DE-UM 6904519 discloses a padding for a packing for breakable or shock- or blow-sensitive articles, in which a light foil of synthetic material is shaped by deep drawing, cavities not required for the small components to be packed are filled more particularly with foamable synthetic materials and the system-consisting of the foil shaped by deep-drawing and of the filling is sealed by a smooth plate of other material, such as cardboard, paper, corrugated board, wood and synthetic material, by gluing, welding, adhesion or pressing, so that a compact padding body is obtained. The manufacture of this packing requires several laborious manufacturing steps and particular tools, which considerably increase the cost for the packing of small components, whose price is sharply calculated. A further disadvantage more particularly for mass production of small components of greatly different shapes is that a large number of different prepared packings, premanufactured in accordance with the shapes of components to be packed, must be constantly kept in stock.

DE-UM 1697030 discloses a packing for bottles, glasses and other breakable articles, which consists of foamed synthetic material, for example polystyrene having substantially closed pores and which is shaped in moulds by casting, pressing or by propellents, at least part of its outer surface having a denser structure as compared with the foam structure. This denser structure may be formed, for example, by action of heat and densification. The aforementioned disadvantages are also inherent in these packing bodies, that is that they must be premanufactured by means of tools, which are to be manufactured separately and which must correspond to the shape of the components to be packed, and that it is required to keep greatly different packing bodies in stock, which is very expensive.

The invention has for its object to simplify the method mentioned in the opening paragraph of packing small components of greatly different shapes in such a manner that the packing is manufactured directly during the packing process in the shape corresponding to the components to be packed and without the use of additional tools.

According to the invention, this object is achieved in that at least one small component to be packed is depressed into the carrier layer which is then heated to a temperature in the range of 70° to 180° C., over such a distance that the small component is firmly held in a compartment formed by thermal deformation of the carrier layer and corresponding to the shape of the small component and in that an area of the carrier layer immediately adjoining the base plate remains substantially undeformed.

According to advantageous further embodiments of the invention, several small components are simultaneously depressed into the carrier layer, the distance between several adjacent small components can be adjusted so that an area of undeformed material of the carrier layer is maintained between the small components.

By the use of a foamed thermoplastic material for the carrier layer, the particular advantage is obtained that the foamed material can be permanently deformed after being heated so that small components to be packed, when they are depressed into this carrier layer, form permanently deformed areas, compartments or nests in the carrier layer, which correspond as accurately as possible to the shape of the small components to be packed and consequently hold the components with clamping fit. For each individual small component to be packed an individual compartment or nest is formed so that even deviations in size of the components within the tolerance range are compensated for. The formation of nests or compartments in this manner can be realized essentially more economically and more rapidly than if, for example, shapes in a carrier material for receiving small components would have to be formed mechanically, for example by cutting or punching which method require a considerable number of tools and an expensive keeping in stock of packings in shaped cavities very accurate to size. Moreover, such methods are also considerably more laborious, which involves disadvantages for a rational mass production.

By means of the method according to the invention, packings accurate to size can be formed immediately on the spot of manufacturing of the small components to be packed, the shaping of the packing being attained by the small components to be packed themselves and not by a separate tool. A further great advantage for a rational mass production is that it becomes considerably simpler for packing material to be kept in stock because only a single kind of starting packing in the form of a packing body having a multilayer construction need be kept ready for small components to be packed of greatly different kinds and shapes, which packing body is formed into its required shape for receiving the small components only on the spot of manufacturing of the small components to be packed. A further advantage of the method according to the invention is that small quantities of small components can be packed as sets in a tray-like packing and that a large number of small components can be combined by stacking a number of such trays, for example in a cardboard box. The free upper side of the small components depressed into the carrier layer is then covered with the base plate of a further packing with small components. For the transport of the whole stack the small components of the uppermost packing body are protected by a suitable protecting cover.

If corrugated board is used for the rigid base plate and, for example, polyethylene foam is used for the carrier layer, the further advantage is obtained that the packing body can readily be subdivided by cutting.

A further advantage is that on a single packing body not only several different small components, which should be processed or machined together in a further processing step, can be sorted and packed, but that also different numbers of small components can be combined and packed rapidly and simply so as to form a set.

Figure 2:
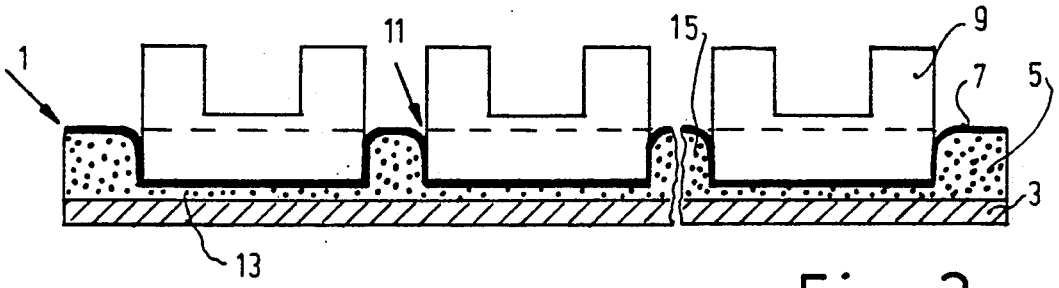
Figure 3:
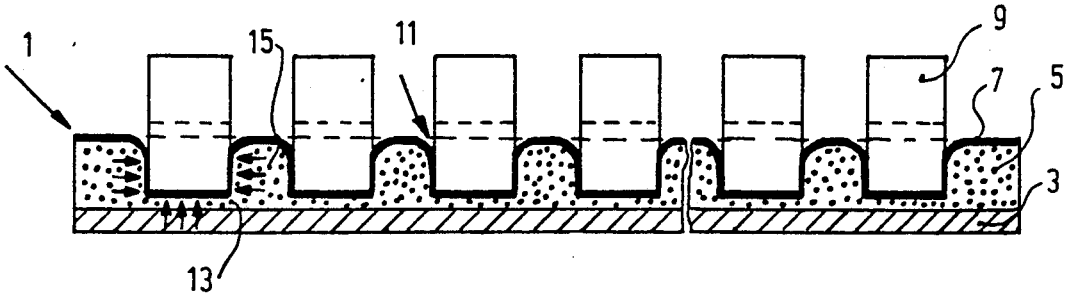

As an embodiment of the invention a method of packing magnetic U-shaped cores of a ceramic ferrite is described. The method according to the invention is of course also suitable, however, for small components of a greatly different kinds, for example glass bottles for medicines, or metal parts whose sensitive surfaces have to be protected during the transport. The invention will be more fully described with reference to the drawing, in which:

FIG. 1 shows a starting packing in the form of a packing body having a multilayer construction in sectional view, FIGS. 2 and 3 show a packing with U-shaped magnetic cores inserted into it in longitudinal section and in cross-section.

FIG. 1 shows in sectional view a packing body 1 in the form of a composite plate comprising an essentially non-deformable base plate 3, for example of mono- or multicorrugated board, having a thickness of 3 to 5 mm and a carrier layer 5, for example of cross-linked polyethylene foam having a density of 0.025 to 0.3 g/cm$^3$, a softening range of 70° to 180° C. and a thickness of $\approx$10 mm and provided with a smooth surface layer 7. The smooth surface layer 7 may be formed in known manner, for example by superficial densification by means of action of heat or, for example, by adhesion or welding of a layer or the like. In the embodiment described, a polyethylene foil having a thickness of 50 $\mu$m has been used to form a smooth surface layer 7. A smooth surface layer 7 may be formed, for example, in known manner by superficial densification by means of action of heat.

FIGS. 2 and 3 show in sectional view the packing body 1 and small components 9 pressed to fit into it, in this case magnetic U-shaped cores of a ceramic ferrite.

The method of packing the small components 9 is carried out so that the packing body 1 and more particularly the carrier layer 5 with the surface layer 7 is heated to a temperature of 160° C. and the small components 9, in this case U-shaped cores having a length of 35 mm, a width of 12.5 mm and a height of 21 mm are depressed at a pressure of 1500 N into a surface area of 320×214 mm$^2$ (dimension of the packing body 1) over such a distance that each component 9 is firmly held in a compartment 11 formed by thermal deformation of the carrier layer 5 and of the surface layer 7 and corresponding to the shape of the small component 9 and that an area 13 immediately adjoining the rigid base plate 3 is maintained substantially without any deformation and areas 15 of the carrier layer 5 located between the individual small components 9 are maintained without any deformation. Each small component 9 thus forms an individual compartment 11 accurate to shape and position, the foamed thermoplastic material of the carrier layer 5 being densified by the action of heat, at the area into which the small components 9 are pressed. At the areas 13 and 15, a residual elasticity is maintained in the material of the carrier layer 5, the lateral resetting forces of the material of the carrier layer 5 acting at the areas 15 so that the depressed small components 9 are held with stress in their compartments 11, which guarantees a safe seat of the small components 9 during a transport. The smooth surface layer 7 constitutes a boundary layer between the small components 9 and the carrier layer 5. It improves the sliding properties of the surface of the carrier layer 5 and thus renders it easier to take the small components 9 out of the composite plate 1.

What is claimed is:

1. A package with small components including a packing body having a multi-layer construction which comprises a substantially rigid base plate and a thermoplastically deformable elastic carrier layer which is fixedly connected to the base plate and which has compartments, each compartment holding an associated small component and corresponding to the shape of its associated small component whereby each such small component is firmly held in place, said package being made in accordance with a method comprising a heating said carrier layer between a temperature in the range of 70° to 180° C., placing a small component on said carrier layer and applying pressure to said small component to press it into said heated carrier layer toward said base plate which forms its associated compartment in said carrier layer, said compartment thereby corresponding to the shape of its associated small component, said carrier possessing the specific property that when said pressure is applied in a prescribed manner the bottom of said compartment immediately adjacent said base plate remains substantially undeformed during the formation of said compartment in said carrier layer.

2. A packing body for packing small components wherein the packing body has a multi-layer construction with a relatively non-deformable base plate and a an elastic carrier layer which is fixedly connected to said base plate, said carrier layer being provided with a smooth surface layer and a plurality of components each holding one of said small components, said packing body being made in accordance with a method comprising a heating said carrier layer between a temperature in the range of 70° to 180° C., placing one of said small components on said carrier layer and applying pressure to said small component to press it into said heated carrier layer toward said base plate which forms one of said compartments in said carrier layer each of which components corresponds to the shape of its associated small component, said carrier layer possessing the specific property that when said pressure is applied in a prescribed manner the bottom of said compartment immediately adjacent said base plate remains substantially undeformed during the formation of said compartment in said carrier layer.

3. A packing body as claimed in claim 2, wherein said carrier layer consists of a foamed material, more particularly one of cross-linked polyethylene foam.

4. A packing body as claimed in claim 3, wherein the surface layer is formed from a polyethylene foil.

5. A packing body as claimed in claim 4, wherein the base plate consists of corrugated board.

* * * * *